US010533831B1

(12) United States Patent
Choiniere et al.

(10) Patent No.: US 10,533,831 B1
(45) **Date of Patent: *Jan. 14, 2020**

(54) DEPLOYABLE, FORWARD LOOKING RANGE SENSOR FOR COMMAND DETONATION

(71) Applicant: BAE SYSTEMS Information and Electronic Systems Integration Inc., Nashua, NH (US)

(72) Inventors: Michael J. Choiniere, Merrimack, NH (US); Jason T. Stockwell, Brookline, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/123,474

(22) Filed: Sep. 6, 2018

(51) Int. Cl.
*F42C 13/02* (2006.01)

(52) U.S. Cl.
CPC ..... *F42C 13/02* (2013.01); *F42C 13/023* (2013.01)

(58) Field of Classification Search
CPC ..... F41G 7/2293; F41G 7/222; F41G 7/226; F41G 7/2253; F42B 15/01; F42C 13/02; F42C 13/023
See application file for complete search history.

(56) References Cited

U.S. PATENT DOCUMENTS 4,176,814 A * 12/1979 Albrektsson ..... F41G 7/222 244/3.15
4,438,893 A * 3/1984 Sands ..... F42B 10/64 244/3.21
4,512,537 A * 4/1985 Sebestyen ..... F41G 7/222 244/3.21
4,561,611 A * 12/1985 Sinclair ..... F41G 7/222 244/3.16
4,568,039 A * 2/1986 Smith ..... F41G 7/222 244/3.15
4,611,912 A * 9/1986 Falk ..... G01S 17/58 356/28.5
4,733,609 A * 3/1988 Goodwin ..... F42C 13/023 102/213
4,859,054 A * 8/1989 Harrison ..... F42C 13/023 356/5.06
4,899,956 A * 2/1990 King ..... F42B 10/661 102/293
5,381,445 A * 1/1995 Hershey ..... F42B 12/36 102/211
5,669,581 A * 9/1997 Ringer ..... F41G 7/222 244/3.16
5,685,504 A * 11/1997 Schneider ..... F41G 7/303 244/3.11

(Continued)

*Primary Examiner* — Michael D David
(74) *Attorney, Agent, or Firm* — Davis & Bujold, PLLC; Scott J. Asmus

(57) ABSTRACT

The system and method for accurately determining range-to-go for the time-delayed command detonation of a projectile. Using dual laser and/or radio frequency detectors on a spinning projectile to determine the range-to-go, time-to-go, or lateral offset from the projectile to the target. The detectors are forward facing and rear facing and are located in a tail kit such that cost can be greatly reduced on a spinning projectile. The deployable detector(s) may be a light pipe, mirrors, or the like and comprise APD or PIN diodes.

18 Claims, 5 Drawing Sheets

(56) References Cited

U.S. PATENT DOCUMENTS

| | | | | |
|---|---|---|---|---|
| 5,835,204 | A * | 11/1998 | Urbach | G01S 7/4863 356/5.01 |
| 6,060,703 | A * | 5/2000 | Andressen | F41G 7/008 250/203.6 |
| 7,533,849 | B2 | 5/2009 | Zemany et al. | |
| 7,999,212 | B1 | 8/2011 | Thiesen et al. | |
| 8,450,668 | B2 | 5/2013 | Maynard et al. | |
| 8,502,127 | B2 * | 8/2013 | McNeish | F42B 15/01 244/3.1 |
| 9,683,814 | B2 | 6/2017 | Dryer | |
| 10,118,696 | B1 * | 11/2018 | Hoffberg | B64C 39/001 |
| 2005/0030219 | A1 * | 2/2005 | Friedrich | F41G 7/226 342/68 |

* cited by examiner

DEPLOYABLE, FORWARD LOOKING RANGE SENSOR FOR COMMAND DETONATION

FIELD OF THE DISCLOSURE

The present disclosure relates to guided munitions and more particularly to deployable, forward looking range sensor for command detonation of a projectile.

BACKGROUND OF THE DISCLOSURE

Precise command detonation maximizes the warhead effects against a target and is highly depended on the "range to go" or "time to go" prior or after impact. Depending on the target and warhead fragment pattern there is an optimum distance in front of the target for soft target (UAS, aircraft, combatants, etc.). For structures, a distance "after" the target, or a delayed detonation, may be useful when flight through a window is preferred, for example. In either case, knowing the time accurately has been difficult. Many simple rounds have used spin counters and by knowing the target range and the number of revolutions/meter from the projectile rifling, one can program the round to detonate after a particular spin count. However, these and other techniques rely on knowing the range to extreme accuracy prior to launch and are totally ineffective for moving targets. What is typically lacking is an architecture that measures the "time-to-go" to the actual target and thereby improves accuracy.

Wherefore it is an object of the present disclosure to overcome the above-mentioned shortcomings and drawbacks associated with conventional guided munitions.

SUMMARY OF THE DISCLOSURE

One aspect of the present disclosure is a method for guiding a projectile, comprising: providing a projectile comprising a tail portion and a nose portion, wherein the tail portion is rotatable along a longitudinal axis of the projectile independently from the nose portion; detecting a first laser signal via a rear facing detector mounted on the tail end of the projectile; determining a first time at which the first laser signal is detected via the rear facing detector of the projectile; detecting a second laser signal via a forward facing detector mounted on the tail portion of the projectile, the second laser signal being the first laser signal that has reflected off a target; determining a second time at which the second laser signal is detected via the forward facing detector of the projectile; comparing the first time to the second time to determine a time delay; determining a lateral offset between the projectile and the target using the time delay between detection by the first detector and detection by the second detector and a speed of the projectile; and calculating an optimum time for detonation of the projectile using a Kaman filter.

One embodiment of the method for guiding a projectile is wherein the rear facing detector of the projectile is an electro-optical PIN diode. One embodiment of the method for guiding a projectile is wherein the forward facing detector of the projectile is an array PIN diode.

Another embodiment of the method for guiding a projectile is wherein a range finding clock is started when the first signal is detected ($T_{zero}$) by the rear facing detector of the projectile and the range finding clock is stopped when the second signal is detected by the forward facing detector of the projectile ($T_{refleeted}$), thereby creating a time differential that represents a round trip time between the projectile and the target which can be converted to a range-to-go.

In some cases, a time to detonation clock is started when a signal is detected by the forward facing detector on the projectile at a time ($T_{start}$) when an angle, theta, is approaching perpendicular to the projectile's direction of travel as the signal is reflected of the fixed target. In certain embodiments, the time to detonation clock is stopped and the projectile is detonated at a time point ($T_{det}$) representing when the projectile is some distance inside the interior of the fixed target.

In yet another embodiment of the method for guiding a projectile according to claim 6, wherein the detonation time point ($T_{det}$) determination is dependent on the projectile speed, the type of structure, and the particular projectile. In some cases, the detonation time point is programmed at the time of launch.

In certain embodiments, the first signal further comprises a first pulse repetition interval and the second signal further comprises a second pulse repetition interval. In some cases, wherein the lateral offset between the projectile's trajectory and the target's actual position is determined by measuring a time expansion between the first pulse repetition interval and the second pulse repetition interval and convolving the projectile's velocity with the time-to-go thereby improving an accuracy of a detonation.

Another aspect of the method for guiding a projectile, comprising: providing a projectile comprising a tail portion and a nose portion, wherein the tail portion is rotatable along a longitudinal axis of the projectile independently from the nose portion; detecting a first RF signal via a rear facing detector mounted on the tail end of the projectile; determining a first time at which the first RF signal is detected via the rear facing detector of the projectile; detecting a second RF signal via a forward facing detector mounted on the tail portion of the projectile, the second RF signal being the first RF signal that has reflected off a target; determining a second time at which the second RF signal is detected via the forward facing detector of the projectile; comparing the first time to the second time to determine a time delay; determining a lateral offset between the projectile and the target using the time delay between detection by the first detector and detection by the second detector and a speed of the projectile; and calculating an optimum time for detonation of the projectile using a Kaman filter.

One embodiment of the method for guiding a projectile is wherein the rear facing detector of the projectile is an end-fire array. One embodiment of the method for guiding a projectile is wherein the forward facing detector of the projectile is an end-fire array.

Another embodiment of the method for guiding a projectile is wherein the first signal further comprises a first pulse repetition interval and the second signal further comprises a second pulse repetition interval. In some cases, the lateral offset between the projectile's trajectory and the target's actual position is determined by measuring a time expansion between the first pulse repetition interval and the second pulse repetition interval and convolving the projectile's velocity with the time-to-go thereby improving an accuracy of a detonation.

Yet another aspect of the present disclosure is a guided projectile, comprising; a rear facing sensor located on a tail portion of the guided projectile for detecting a laser or radio frequency signal; a forward facing detector sensor located on a forward portion of the guided projectile and detecting a reflected laser or radio frequency signal from a target; a computer readable storage device having instructions, which when executed by a processor, cause the processor to execute: determining a first time at which the laser beam is detected via the rear facing detector; determining a second time at which the reflected signal is detected via the forward facing detector; comparing the first time to the second time to determine a time delay; determining an azimuth and an elevation of the guided projectile based on the detected laser or radio frequency signal by the rear facing detector; and determining one or more of the following using the time delay between detection by the rear facing detector and detection by the forward facing detector: a lateral offset between the projectile and the target; a time-to-go for the projectile to reach the target; and a range-to-go for the projectile to reach the target.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

Figure 1A:
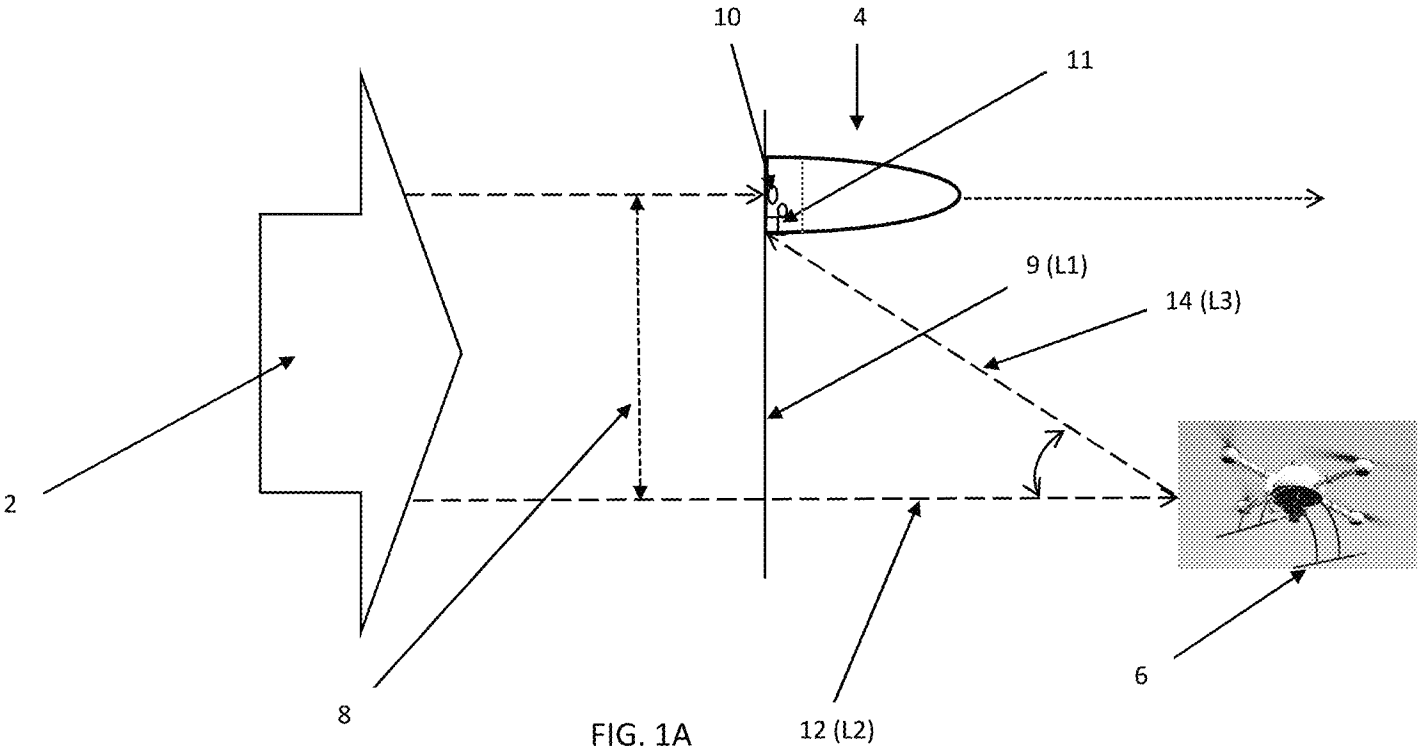
FIG. 1A shows one embodiment of the system of the present disclosure.

One embodiment of the present disclosure is a system for accurately determining the range-to-target distance for a guided munition. In one embodiment, the accuracy is within less than a meter. In some cases, the system utilizes a low energy, short pulse laser (e.g., fiber laser) or radio frequency pulse to paint a target. The short pulse can be 1 to 50 nanoseconds depending on the transmitter. In some cases, the system is low power since the path is one way from the illuminator to the projectile. In certain embodiments, low energy is about 100 μJoules per pulse.

When munitions are laser guided a target is illuminated, or "painted," by a laser target designator on the ground or on an aircraft. One disadvantage of typical laser guided munitions is that in poor weather the system may not be useable because the target illumination cannot be seen, or if the target designator cannot get near the target. In certain embodiments, a laser designator sends a beam in a coded series of pulses so the munition will identify the proper signals, and in that way multiple designators can operate in the same region.

In certain embodiments of the system of the present disclosure, the munitions are guided with radio control. In some cases, an aircraft transmits control signals to the munition to guide it to the target. In some cases, the RF or laser signal emanates from a plane or vehicle weapon fire control system. A fire control system guides the weapon to the target using detection by radio frequency (RF), electro-optical (EO), or a combination of the two modalities to illuminate and track a target during the terminal end game or in the region near the target.

In certain embodiments, the target may be large and fixed, but in other embodiments the target may be a small, moving target or something in between. In one embodiment, the target is an unmanned vehicle, such as a drone. In one embodiment, the target is vehicle, such as an air or land vehicle. In one embodiment, the target is building or other fixed structure.

In certain embodiments of the system of the present disclosure, a spinning projectile, or munition, is guided to the target from a tracking station. In some cases, a tracking station may be on the ground, such as part of command and control. In some cases, the tracking station may be on a vehicle. In certain embodiments, the munition is guided by a fire control system on the munition launch platform.

In some cases, the munition is spinning at 5-20 k revolutions/second. In some cases, the munition is a fly-by projectile that has a directional blast pattern that necessitates accurate detonation in order to hit the target as accurately as possible while mitigating unintended hits or misses. In some embodiments, the blast pattern may be about 1-3 m wide.

In certain embodiments, a fiber laser, or the like, is used to emit radiation to paint the target(s) and/or to track the munition(s). In some cases, the emitted radiation is used to provide an azimuth (Az) and an elevation (El) bearing for the projectile relative to the target. In some cases, the radiation will hit the back of the projectile and reflect back to the tracking station, or the like. In some cases, the tracking station reports only the Az and El position for the projectile, thus simplifying the EO/RF system used in an embodiment of the present command detonation system.

One aspect of the present disclosure is a system comprising a radio frequency (RF) or laser short energy pulse (10 to 100 ns) that illuminates a projectile's rear end sensor and one or more targets. The energy of the short energy pulse is reflected off the target and is received by a second sensor on the back side of the projectile that is forward-looking. The first sensor detects the pulse energy as it passes by the projectile, generating a $T_0$ (i.e., the start of a range finding clock). The clock is stopped when the target's reflected energy is detected by the second sensor at a second time point $T_2$. The time differential represents the round trip time between the projectile and the target which can be converted to a range.

In one embodiment of the system of the present disclosure, the system uses the measured energy detection from sensor 1 and sensor 2 in a simple limit trip switch approach. When the time-to-go is time <0.0015 seconds, or the like, the projectile is signaled to detonate. In certain embodiments, the time chosen is dependent on the projectile speed, warhead ideal detonation distance, and other factors. The "time-to-go" could be a time variable programmed at launch and/or could be negative (e.g., when flying through a window).

Another embodiment of the present disclosure determines the lateral offset between the projectile's trajectory and the target's actual position (i.e., a lateral miss distance). In this embodiment, the projectile's rear end sensor(s) determine the projectile's velocity by measuring the time increase between each pulse interval. The time base of each illumination pulse or the pulse repetition interval (PRI) serves as means to measure the time expansion between pulse intervals. If the projectile was not moving, the PRI would match the expected PRI. In one example, for a 40 Hz system the PRI is 25 milliseconds. If a projectile is at MACH 3 it would travel 25 meters. The 25 meters→81 feet→81 nanosecond (speed of light) increases the PRI time base which can be measured and tracked. By convolving the velocity of the projectile with the "time-to-go" to the target, one can determine the lateral offset for the projectile, thereby improving/optimizing the accuracy of the detonation.

In certain applications, high damage percentage detonations need to ensure the target is within a damage zone by measuring the actual offset angle to the projectile relative to the threat. One embodiment of the present disclosure is placing a PIN diode on the rear end of the projectile and a deployable, forward-facing light pipe on the projectile's tail end. By painting the target with a low power, short pulse laser (e.g., a fiber laser), the rear facing detector generates a time zero ($T_0$) and the laser return off the target at the second detector generates the range-to-go and angle between the projectile's centerline and the threat at a second time point ($T_2$). By using range and the speed of the projectile, the optimum command detection can be realized.

In some cases, the rear facing detector/antenna generates a time zero ($T_0$) as well as Az and El information for the projectile. In certain embodiments, a laser return off the target, which is detected by the forward-facing detector on the projectile at a second time point ($T_2$), generates the range-to-go to the target. This method eliminates the need to determine the range at the tracking station, thus reducing the cost of the scanner and the peak power required for the laser used to paint the target.

In some cases, the system also eliminates the complex latency of the tracking system since the projectile acts as its own reference. By using the same laser output, and mounting a pair of receivers on the projectile, the power losses are reduced from $R^4$ and approach $R^2$ losses. In a traditional system where the fire control system uses RADAR or LIDAR to track the projectile and the target, the power losses are in terms or range$^4$ or $R^4$. The energy goes out to both the target(s) and projectile(s) generating $R^2$ losses in the outgoing and the return energy; thereby producing $R^4$ losses. In this embodiment, the use of one path ($R^2$) reduces the power needed from megawatts to kilowatts or reduces the power needed by the square root of the power needed for a RADAR or LIDAR. It is assumed that this is first order and neglects environmental losses.

Since unmanned aircraft are very small, LIDAR and RADAR are ineffective at generating range-to-go for a projectile to the target due to the small signatures of the targets. By tracking them with EO sensors at the fire control system, the azimuth (Az) and elevation (El) of the target can be determined. There, range still remains difficult given the weak return signal, but the projectile can still be launched and guided to the target using a version of line of sight (LOS) command guidance. As the projectile approaches the target, the weak signal goes from $R^4$ at the beginning of the flight to $R^2$ prior to target contact. Even a weak signal is detected with the system of the present disclosure since the receivers are now on the projectile.

Referring to FIG. 1A, one embodiment of the disclosure is shown. More specifically, a laser pulse and/or an RF pulse 2 is propagated in the direction of a target 6 and a munition 4. The laser pulse and/or RF pulse is used to determine the Az and El of the projectile by detecting reflected signals with sensors located on the projectile. The error 8 associated with the Az and El data is determined by a Fire Control EO/RF subsystem in certain embodiments. In some cases, the Fire Control subsystem is located on the projectile's launch platform. In certain embodiments, a rear facing detector 10 mounted on the rear end of the projectile 4 detects the laser pulse and/or RF pulse and establishes a time zero ($T_0$). In some cases, the laser pulse and/or RF pulse is reflected 14 off the target 6 and is detected by a forward facing detector 11 on the tail of the munition/projectile at a second time point ($T_2$). In some cases, the forward-facing detector is an array PIN diode. In some cases, the rear-facing and/or forward-facing detector is connected to a light pipe. In certain embodiments, a light pipe/waveguide is deployed into the airstream that looks forward to detect the returning pulse energy off the target. The returning pulse is compared to the outgoing detection as the original pulse passes the projectile. This is easier and cheaper that other embodiments that have the second sensor on the nose of the projectile where the explosive is located (other work by Applicant).

Still referring to FIG. 1A, determining the time delay between the detection of the radiation signal at the rear-facing detector 10 on the munition 4 and the detection of the reflected radiation signal 14 off the target 6 by the forward-facing detector 11, allows a range-to-go to be calculated. This approach also allows the projectile 4 to know its lateral offset from the target. In some embodiments, the lateral offset is determined by the Fire Control system and the time-to-go is determined from the laser/RF pulse. By using the time delay calculated from the differential path 12, an accurate detonation time can be set. In other words, a first signal is detected by the rear facing detector 10 mounted on the rear end of projectile 4 and a second reflected signal 14 is detected by the forward facing detector 11 located on the tail of the projectile 4 as the signal is reflected back from the target 6. This can be used to very accurately determine the range to a target that can then be used to execute a function such as detonation of a warhead. Additionally, the system of the present disclosure can be used on any vehicle that requires a means to detect range information from a transmitter source.

Figure 1B:
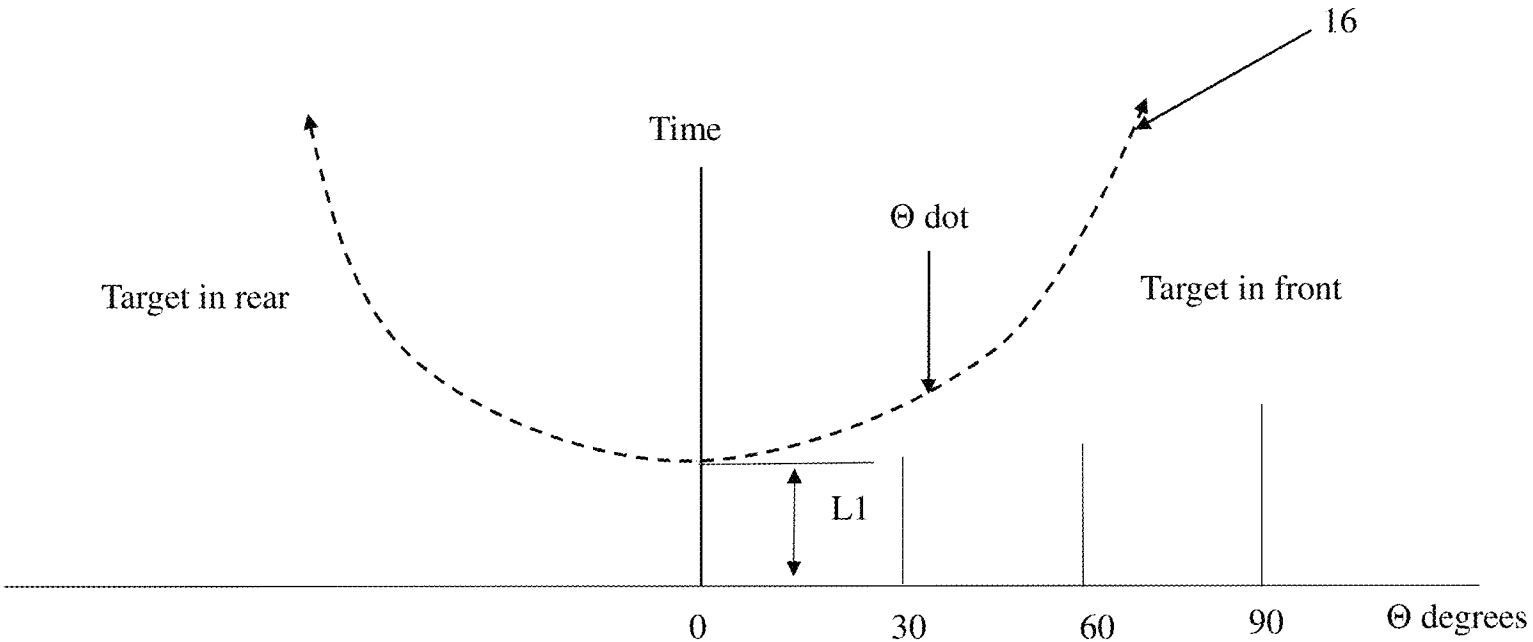
FIG. 1B shows calculations for range-to-go, lateral offset, and the like according to the principles of the present disclosure.

Referring to FIG. 1B, the calculations for range-to-go, lateral offset, and the like according to the principles of the present disclosure are shown. More specifically, a plot of theta, θ, against time is shown. The lateral offset L1 is shown. There is it possible to see that as the projectile (e.g. munition) flies over the target, the distance and thus the time from the munition 16 is asymptotic such that the curve goes from 0° when the projectile is directly over the target and approaches 90° when the projectile is about 20 to 50 meters away from the target, ignoring the length of the munition. At that point, as shown in FIG. 1A, it would be near linear (L2=L3) and L1 would come into play and be a minor contributor. Where sin Θ=L2/L3, Time=L2+L3 (ignoring the weapon length); L3=time/(sin Θ+1) and L2=sin Θ*L3.

In certain embodiments, the front-facing and/or rear-facing detectors 10 are EO PIN diodes. In some cases, the forward looking detector 11 is an array PIN diode, avalanche photodiodes (APD), or camera. An RF sensor has the advantage of being all weather, but an RF sensor has the disadvantage of large beams ~2-3° or larger depending on the application. In a UAV swarm environment RF provides large area coverage for a lower cost than electro-optical (EO) systems. EO systems using a laser or narrow beam illuminators can direct the energy at longer distances to a specific target feature; a wall on a building, a door, a window, etc. It is understood that the spatial control of some weapon systems may gravitate to an EO system for higher precision.

Figure 2:
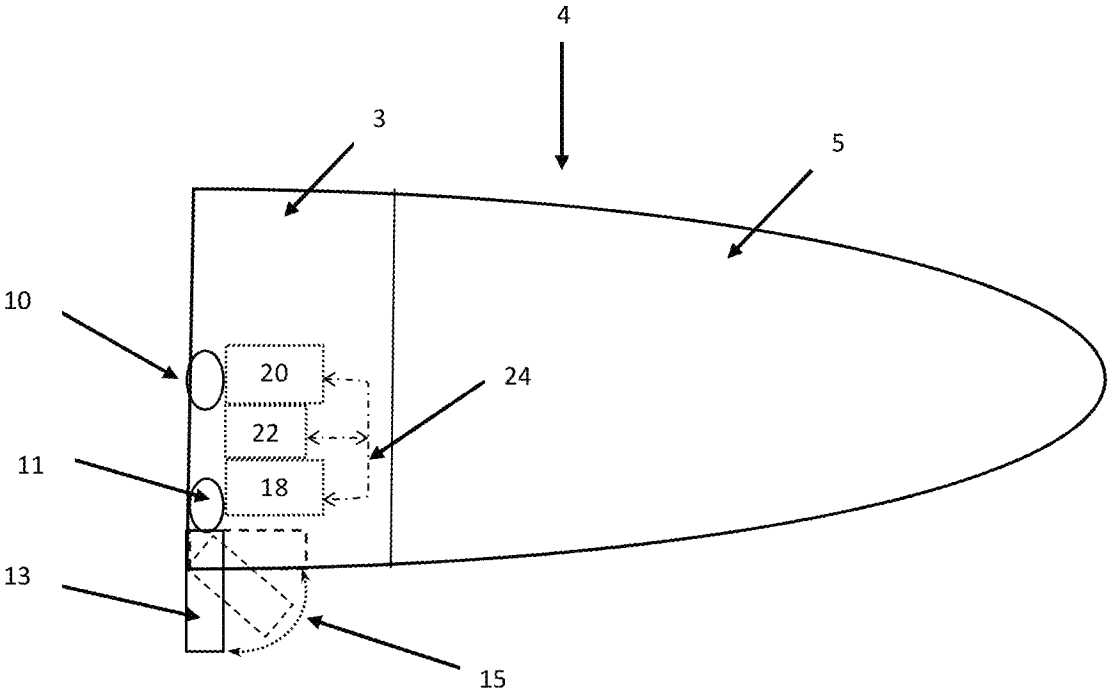
FIG. 2 illustrates two sensors with detector electronics and an associated processor on a munition according to the principles of the present disclosure.

Referring to FIG. 2, the construct of two sensors located on the munition according to the principles of the present disclosure is shown. The munition could be a guided projectile from a 0.5 caliper sniper round to a 155 mm artillery shell. The guidance package could be spinning with respect to the ordnance or could be roll stabilized using a bearing between the ordnance the guidance package. In some cases, the guidance component package comprises an EO detection aperture—light pipe, fiber optic pipe, mirror, prisms, or the like, in an optical configuration that routes light energy to one or more diodes. The signal generated by the diode would be measured either through an A/D or threshold comparator to determine the arrival times for both sensors and calculated by the processor. A simple mechanical mechanism could slide, rotate, or use a combination of motions, to install the EO collecting aperture into the airstream.

An RF component kit in one example would replace the optics with conformal antennas along the weapons body. In FIG. 2, the forward portion of the munition 5 is rotatable about a longitudinal axis of the projectile separate from the tail portion 3. The emerging technology to guide a projectile utilizes a tail kit that is attached to the rear of the projectile 4. The tail kit is typically de-spun from the front section of the projectile (20,000 RPM). The tail kit now in a slow roll (0 to 100 RPM) can execute guidance using control surfaces on the tail kit. The second detector being in the tail kit lowers the cost and complexity of having a second detector on the spinning front section of the projectile.

In some cases, the time measurements can be accomplished with the elements shown in FIG. 2. More specifically, a front-facing detector 11, may comprise an EO with one or more lenses, an array PIN diode, a camera, or the like. A light pipe would utilize a PIN diode, APD, or the like. In certain embodiments, the forward-facing detector 11 comprises a deployable light pipe 13 that swings out 15 from the tail portion of the projectile 4 to detect the signals reflected off the target. In some cases, the light pipe 13 is a flip out mirror feature. This methodology avoids the needs to place the forward-facing detector 11 on the explosive end of the projectile. In some cases, the tail portion 3 can be disconnected from the nose portion 5 (e.g., the tail portion does not spin). In some cases, the tail portion 3 acts as a rudder for steering. In this case, the light pipe will always be "seeing" the target.

Figure 3B:
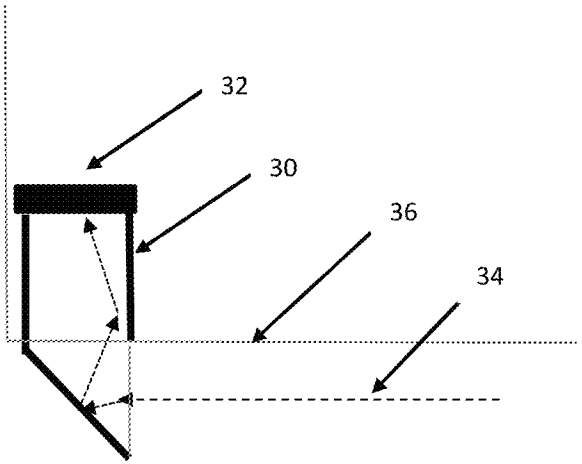
FIG. 3B shows one embodiment of the deployable detector system of the present disclosure in the deployed position.
Figure 3A:
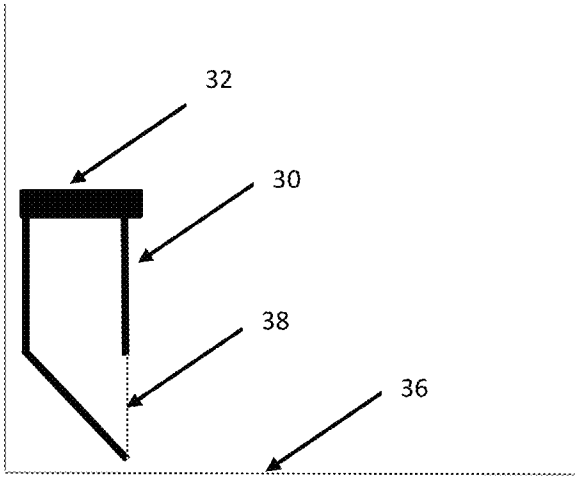
FIG. 3A shows one embodiment of the deployable detector system of the present disclosure in the stored position.

Referring to FIG. 3A and FIG. 3B, one embodiment of the deployable, forward looking range sensor for command detonation concept of the present disclosure is illustrated with a sliding detector assembly. More specifically, FIG. 3A depicts a simple prism module with mirror surfaces 30, a window 38, and a detector 32, not yet deployed. In FIG. 3A, the module is shown within the projectile body 36. In FIG. 3B, the prism assembly is slid out, or deployed, into the airstream and the light energy 34 is received through the window 38, collected and routed to the detector 32 using the mirror surfaces 30.

One aspect of the present disclosure is installing two PIN diodes looking both backwards and forward. The backwards facing PIN diode detects the outgoing laser energy and generates a $T_{zero}$ as it passes by the weapon. The laser energy continues to the target and reflects off the target and returns to the forward looking PIN Diode. The time difference between the first and second detector determines the range-to-go. By placing the second detector on the weapon's rear, it eliminates the need for electronics in the front of the weapon. With the weapon directly between the second diode and the target, a small light pipe, fiber pipe, mirror, or optical assembly can be moved into the airstream to capture light and route to the detection diode (e.g., PIN or APD). In certain embodiments, deployment would be just prior to detonation when the weapon is making its final terminal trajectory. The forward looking aperture could range from 1 to 10 $mm^2$ depending on the target reflectivity and laser fluence on the target.

In one embodiment of the system of the present disclosure, the system comprises of an RF solution with a rear and front facing antenna. In this embodiment, the second antenna could utilize an end-fire array to look forward. The end-fire array that is mounted on the side of the weapon but is looking broadside, forward toward the target. In some cases the end-fire array can be configured to look both forward and aft.

Using a fiber laser generating high pulse repetition frequency signals (PRF) 2, a fire control system (not shown) can paint both the projection for azimuth (Az) and elevation (El) tracking information for a munition 4, and an exterior surface of a structure, or target. In one embodiment, a front facing detector and a rear facing detector on a projectile are used to determine the position of the exterior surface of a structure, or building, relative to the projectile 4. In certain embodiments, a front facing detector is used to accurately measure the range-to-go can be determined using the time delay 12. Using the projectile speed, the round trip time, 12+14, can be used to determine the lateral offset 8. If the target is line with the trajectory, the 12 would equal 14. As the lateral offset grows, the hypotenuse 14 becomes longer. By knowing the projectile speed and measuring the time-to-go, one can estimate the lateral offset and determine the optimum time to detonate give the warhead fragmentation pattern.

In some cases, when the angle reaches a limit (e.g., perpendicular to the direction of travel of the projectile) a time to detonation clock is started ($T_{start}$). In this case, a plane is defined by the location where a projectile would pass from outside a structure, or building, to inside a structure, or building. In some cases, the plane may be collocated with a window or the like. At the point, $T_{start}$, where the projectile crosses the plane a time to detonation clock is started. In some cases, a certain amount of time can be added to $T_{start}$ to arrive at $T_{det}$ (for the time to detonate). This provides for the proper penetration into a building or structure prior to detonation and this offset value depends on several factors, including, but not limited to, the blast pattern for a particular munition, the type of structure, the speed of the munition, and the like.

Most conventional systems use a range-to-target determined by the fire control system, which may be off by several meters. The system and method of the present disclosure is determined on the munition in real-time, and thus has no latency issues and is highly accurate. In some cases, the accuracy is less than about 0.2 meters.

Figure 4:
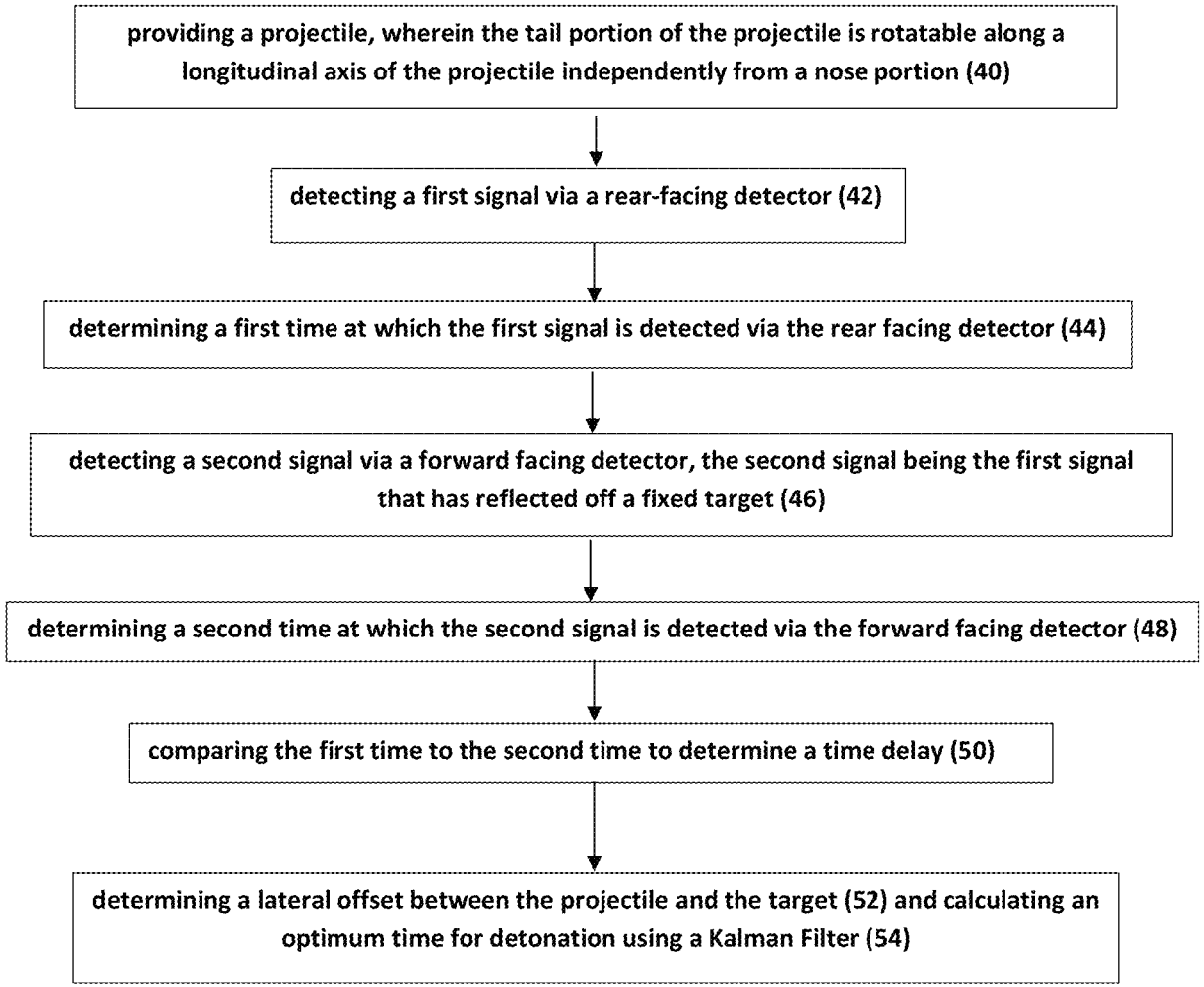
FIG. 4 shows one embodiment of a method according to the principles of the present disclosure.

Referring to FIG. 4, a flowchart of one embodiment of a method according to the principles of the present disclosure is shown. More specifically, the system comprises a projectile having a tail portion and a nose portion, wherein the tail portion is rotatable along a longitudinal axis of the projectile independently from the nose portion (40) the system detects a first laser or radio frequency signal via a rear-facing detector mounted on the tail portion of a projectile (42) and determines a first time at which the first laser or radio frequency signal is detected via the detector mounted on the tail portion of the projectile (44). The system detects a second laser or radio frequency signal via a forward-facing detector mounted on the nose portion of the projectile, the second laser or radio frequency signal being the first laser or radio frequency signal that has reflected off a target (46) and determines a second time at which the second laser or radio frequency signal is detected via the detector mounted on the nose portion of the projectile (48). The system compares the first time and the second time to determine a time delay (50). Next, by determining a lateral offset between the projectile and the target (52) and calculating an optimum time for detonation using a Kalman Filter, improved projectile control is possible (54).

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A method for guiding a projectile to a target, comprising:

providing a projectile comprising a tail portion and a nose portion, wherein the tail portion is rotatable along a longitudinal axis of the projectile independently from the nose portion;

detecting a first laser signal via a rear facing detector mounted on the tail end of the projectile;

determining a first time at which the first laser signal is detected via the rear facing detector;

detecting a reflected laser signal via a forward facing detector mounted on the tail portion of the projectile, the reflected laser signal being the reflected laser signal off the target;

determining a second time at which the reflected laser signal is detected via the forward facing detector of the projectile;

comparing the first time to the second time to determine a time delay;

determining a lateral offset between the projectile and the target using the time delay between detection by the rear facing detector and detection by the forward facing detector and a speed of the projectile; and calculating an optimum time for detonation of the projectile using a Kaman filter.

2. The method for guiding a projectile according to claim 1, further comprising sending a signal to detonate the projectile at the optimum time.

3. The method for guiding a projectile according to claim 1, wherein the rear facing detector of the projectile is an electro-optical PIN diode.

4. The method for guiding a projectile according to claim 1, wherein the forward facing detector of the projectile is an array PIN diode.

5. The method for guiding a projectile according to claim 1, wherein a range finding clock is started when the first signal is detected ($T_{zero}$) by the rear facing detector and the range finding clock is stopped when the second signal is detected by the forward facing detector ($T_{reflected}$), thereby creating a time differential that represents a round trip time between the projectile and the target which can be converted to a range-to-go.

6. The method for guiding a projectile according to claim 5, wherein a time to detonation clock is started when a signal is detected by the forward facing front detector on the projectile at a time ($T_{start}$) when an angle, theta, is approaching perpendicular to the projectile's direction of travel to the reflected signal off the target.

7. The method for guiding a projectile according to claim 6, wherein the time to detonation clock is stopped and the projectile is detonated at a time point ($T_{det}$) representing when the projectile is some distance within an interior of the target.

8. The method for guiding a projectile according to claim 7, wherein determining the detonation time point ($T_{det}$) is dependent on at least one of the projectile speed, the type of structure, and the particular projectile.

9. The method for guiding a projectile according to claim 7, wherein the detonation time point ($T_{det}$) is programmed at the time of launch.

10. The method for guiding a projectile according to claim 1, wherein the first laser signal further comprises a first pulse repetition interval and the reflected laser signal further comprises a second pulse repetition interval.

11. The method for guiding a projectile according to claim 10, wherein the lateral offset between the projectile's trajectory and the target's actual position is determined by measuring a time expansion between the first pulse repetition interval and the second pulse repetition interval and convolving the projectile's velocity with the time-to-go thereby improving an accuracy of a detonation.

12. A method for guiding a projectile, comprising:

providing a projectile comprising a tail portion and a nose portion, wherein the tail portion is rotatable along a longitudinal axis of the projectile independently from the nose portion;

detecting a first radio frequency (RF) signal via a rear facing detector mounted on the tail of the projectile;

determining a first time at which the first RF signal is detected via the rear facing detector of the projectile;

detecting a second RF signal via a forward facing detector mounted on the tail of the projectile, the second RF signal at least partially being the first RF signal that has reflected off a target;

determining a second time at which the second RF signal is detected via the forward facing detector of the projectile;

comparing the first time to the second time to determine a time delay;

determining a lateral offset between the projectile and the target using the time delay between detection by the rear facing detector and detection by the forward facing detector and a speed of the projectile; and calculating an optimum time for detonation of the projectile using a Kaman filter.

13. The method for guiding a projectile according to claim 12, wherein the rear facing detector of the projectile is an end-fire array.

14. The method for guiding a projectile according to claim 12, wherein the forward facing detector of the projectile is an end-fire array.

15. The method for guiding a projectile according to claim 12, wherein the first signal further comprises a first pulse repetition interval and the second signal further comprises a second pulse repetition interval.

16. The method for guiding a projectile according to claim 15, wherein the lateral offset between the projectile's trajectory and the target's actual position is determined by measuring a time expansion between the first pulse repetition interval and the second pulse repetition interval and convolving the projectile's velocity with the time-to-go thereby improving an accuracy of a detonation.

17. A guided projectile, comprising;

a tail portion and a nose portion, wherein the tail portion is rotatable along a longitudinal axis of the projectile independently from the nose portion;

a rear facing detector located on the tail portion of the guided projectile for detecting a laser or radio frequency signal, wherein the laser or radio frequency signal is from a fire control system;

a forward facing detector located on the tail portion of the guided projectile and detecting a reflected laser or radio frequency signal from a target;

a computer readable storage device having instructions, which when executed by a processor, cause the processor to execute:

determining a first time at which the laser or radio frequency signal is detected via the rear facing detector;

determining a second time at which the reflected laser or radio frequency signal is detected via the forward facing detector;

comparing the first time to the second time to determine a time delay;

determining an azimuth and an elevation of the guided projectile based on the detected laser or radio frequency signal by the rear facing detector;

determining one or more of the following using the time delay between detection by the rear facing detector and detection by the forward facing detector; a lateral offset between the projectile and the target; a time-to-go for the projectile to reach the target; and a range-to-go for the projectile to reach the target; and calculating an optimum time for detonation of the projectile using a Kaman filter.

18. The guided projectile according to claim 17, wherein instructions cause the processor to further execute: sending a signal to detonate the guided projectile at the optimum time.

* * * * *